US006290189B1

(12) United States Patent
Heim

(10) Patent No.: US 6,290,189 B1
(45) Date of Patent: Sep. 18, 2001

(54) SWITCHING DEVICE FOR SWITCH TONGUES

(75) Inventor: Armin Heim, Kreuzlingen (CH)

(73) Assignee: Schwihag Gesellschaft für Eisenbahnoberbau mbH, Tügerwilen (CH)

( * ) Notice: Subject to any disclaimer, the term of this patent is extended or adjusted under 35 U.S.C. 154(b) by 0 days.

(21) Appl. No.: 09/202,230

(22) PCT Filed: Jun. 10, 1997

(86) PCT No.: PCT/EP97/03003

§ 371 Date: Aug. 30, 1999

§ 102(e) Date: Aug. 30, 1999

(87) PCT Pub. No.: WO97/47813

PCT Pub. Date: Dec. 18, 1997

(30) Foreign Application Priority Data

Jun. 11, 1996 (DE) ..... 196 23 295

(51) Int. Cl.[7] ..... E01B 7/00

(52) U.S. Cl. ..... 246/449

(58) Field of Search ..... 246/415 R, 435 R, 246/438, 439, 442, 449, 450, 451, 452, 453

(56) References Cited

U.S. PATENT DOCUMENTS

| | | | | |
|---|---|---|---|---|
| 1,637,919 | * | 8/1927 | Sampson | 246/450 |
| 2,046,568 | * | 7/1936 | Lundy | 246/452 |
| 2,316,312 | * | 4/1943 | Bone | 246/450 |
| 2,401,294 | * | 6/1946 | Clymer et al. | 246/452 |
| 2,712,914 | * | 7/1955 | Lavarack et al. | 246/452 |
| 2,730,319 | * | 1/1956 | Arnold et al. | 246/452 |

* cited by examiner

*Primary Examiner*—Mark T. Le
(74) *Attorney, Agent, or Firm*—Sidley Austin Brown & Wood, LLP

(57) ABSTRACT

In a point-operating device for pressing one tongue (28) against a stock rail (3) and for simultaneous pull-off of another tongue (29) from an opposite stock rail (4), the operability is improved when between the stock rails/tongues of a point, a moving device, which is formed with at least four adjustable vertical spring assemblies (8, 9, 12, 13), is arranged.

5 Claims, 4 Drawing Sheets

SWITCHING DEVICE FOR SWITCH TONGUES

Figure 1:
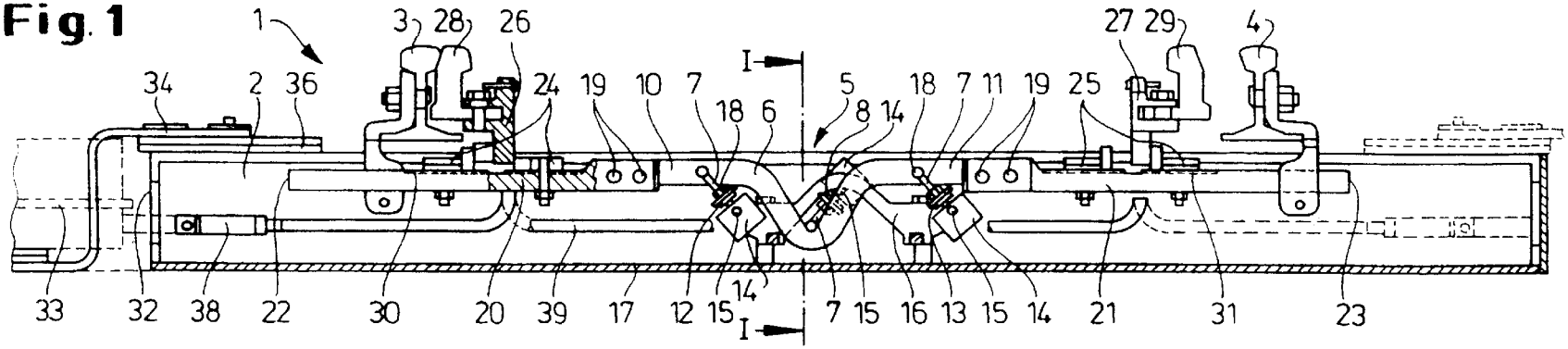

The invention relates to a point-operating device for pressing one switch tongue against a stock rail and for simultaneous withdrawal of another switch tongue from an opposite stock rail.

At high speeds in track points with the passing speed reaching 160 km/h, however, in particular, 250 km/h in points of high-speed section of a straight track, it is necessary that a respective switch tongue, which lies on a stock rail, has a perfect contact both in the stop region of the tongue and in the following bearing studs. This is very important to avoid movement of tongue regions, which do not lie on their support elements, during travelling under load, which practically is equal to track narrowing. Therefore, to prevent the track narrowing, it is necessary that before passing of a train, all of the switch tongue regions are supported on the support elements. It is also necessary that the other switch tongue, namely the tongue spaced from the stock rail, be spaced from the stock rail not less than 58 mm.

The cause of non-observance of a minimum distance of 58 mm or of the tongue not lying over its entire length is a so-called "hanging-up" of the tongue during switching which results from high frictional forces and a possible plastic horizontal deformation.

In order to eliminate both drawbacks, the not-lying of the movable tongue and not sufficiently wide opening between the spaced tongue and the stock rail or not sufficient spacing of the spaced tongue from the stock rail, so-called clamp middle locks or fork-like locks are provided in the region of the narrowest opening, i.e., mainly in the region of a complete face width of the tongue. Thereby, it is achieved that the used tongue lies on the support regions provided therefor, and the minimal distance between the stock rail and the spaced tongue does not fall below a predetermined value.

With the clamp lock, the lying tongue is clamped to the stock rail, whereas with the fork-like lock, the lying tongue is only pressed against the stock rail, and the spaced tongue is pulled off a distance of 58 mm.

In present mostly old point-operating devices, for switching a switch tongue, only a drive, with a point detector the tongue tip, is provided. In order to bring into contact the tongue regions located behind the tongue tip before movement of the contracting tongue and to pull-off the spaced tongue from the stock rail a sufficient distance, clamp and fork-like locks are correspondingly positioned with driving linkages which are adjusted by a tongue tip motor. A respective transmission linkage of a drive linkage and which is arranged in front of the face of the cross-tie makes the necessary compression of the ballast in front of the cross-tie face, which is necessary for increasing the positional stability, practically impossible. Thereby, the positional stability of the cross-tie is reduced which leads to the track distortion and primarily to increased maintenance costs.

The problem of previously made manual packing, from outside, of both cross-tie of a cross-tie box by using a drive or point detector linkage was solved by using of box-type cross-ties for both wooden cross-tie points and concrete cross-tie points, however, here also the use of a drive linkage from the tongue tip motor requires the use of the clamp and fork-like locks with all their, discussed above, drawbacks.

The prior art also discloses the use of so-called bow suspensions for switching tongue in a point. They are arranged in a space between the cross-ties, so that both cross-ties of a cross-tie box are packed only at one side. Neither mechanized nor manual packing from the inner side of both ties of a cross-tie box is possible. A further drawback of the known bow suspension consists in that it has only two spring assemblies. Therefore, when one spring assembly breaks, the bow suspension becomes inoperable. Similarly, with two spring assemblies, when one spring assembly is broken, the remaining spring assembly cannot provide the force necessary for switching of the tongues. Thus, both spring assemblies becomes inoperable with breaking of one spring assembly and the bow suspension should be either repaired, which is costly and time consuming, or be replaced. Further, the drive linkage for the fork-like lock has a drawback which primarily consists in the temperature-dependent length changes of the drive linkage, which takes place at low and/or high temperatures.

Accordingly, an object of the invention is a point-operating device without the above-discussed drawbacks.

This object is achieved, according to the invention, by arranging between the stock rails/switch tongues of a point a moving device with at least four adjustable spring assemblies. The four spring assemblies can, after the preadjustment of the spring assemblies, provide, horizontally, a pressure force of 4×400 N=1,600 N. This enables the switch tongue, which lies on the stock rail, to be reliably pressed against the stock rail and insures that the spaced switch tongue is pulled off the stock rail a sufficient distance. At that, the necessary minimal spacing of 58 mm is exactly retained, and the back of a wheel can pass this open region without descending, which is particular important at high speeds. Because the four spring assemblies provide a high pressure force, it is also possible to use a moving device with six spring assemblies, the clamp and fork-like locks can be dispensed with.

According to an advantageous embodiment of the present invention, the moving device is formed as a bow suspension having a tandem spring assembly in the middle and a spring assembly at its left and right ends. Each spring assembly consists of a spring socket in which a spring arranged on a pressure rod is received. The bow suspension is V-shaped. In its middle, two spring assemblies, located next to each other, are provided. The tandem arrangement insures that with breaking of one of the adjacent spring assemblies, the bow suspension remains operational. Furthermore, the spring assemblies provided at the outer ends of the bow suspension primarily serve for increasing the applied forces. The sockets of the spring assemblies advantageously are arranged in a carrier frame which can easily be fixedly connected with a cross-tie. Push rods connect the outer ends of the bow suspension with the tongues of the point. The bow suspension is operated by moving the tongue with a point drive motor arranged in the region of the tongue tip.

According to a further embodiment of the invention, the push rods are provided each with a toothing. The toothing adjustably connects a tongue with the push rod. Thereby, it is possible to compensate manufacturing tolerances, but particularly, to adapt to predetermined thicknesses of the tongue face, in accordance with the position of the bow suspension, to respective characteristics or parameters, among others, to the prestress of the spring assemblies.

Advantageously, the inventive bow suspension is mounted in a box-type cross-tie. Thereby, it is possible to better maintain the operability of the bow suspension, while protecting it against environmental influences and, besides, packing of the box-type cross-tie can be effected automatically with a point tamping machine. Thereby, maintenance costs and the possibility of a failure of a point are substantially reduced.

For monitoring of both switch tongue, two simple mechanical point detectors can be used because the otherwise necessary signaling monitoring of a drive linkage of a previously necessary fork-like lock has been eliminated.

Figure 2:
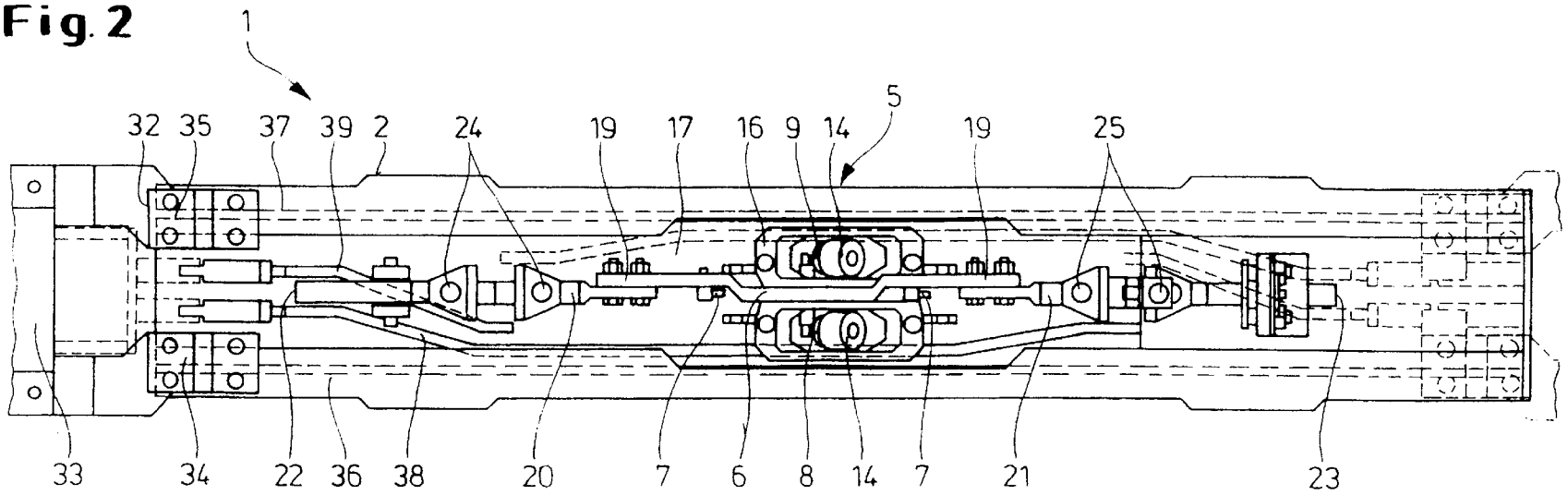
Figure 3:
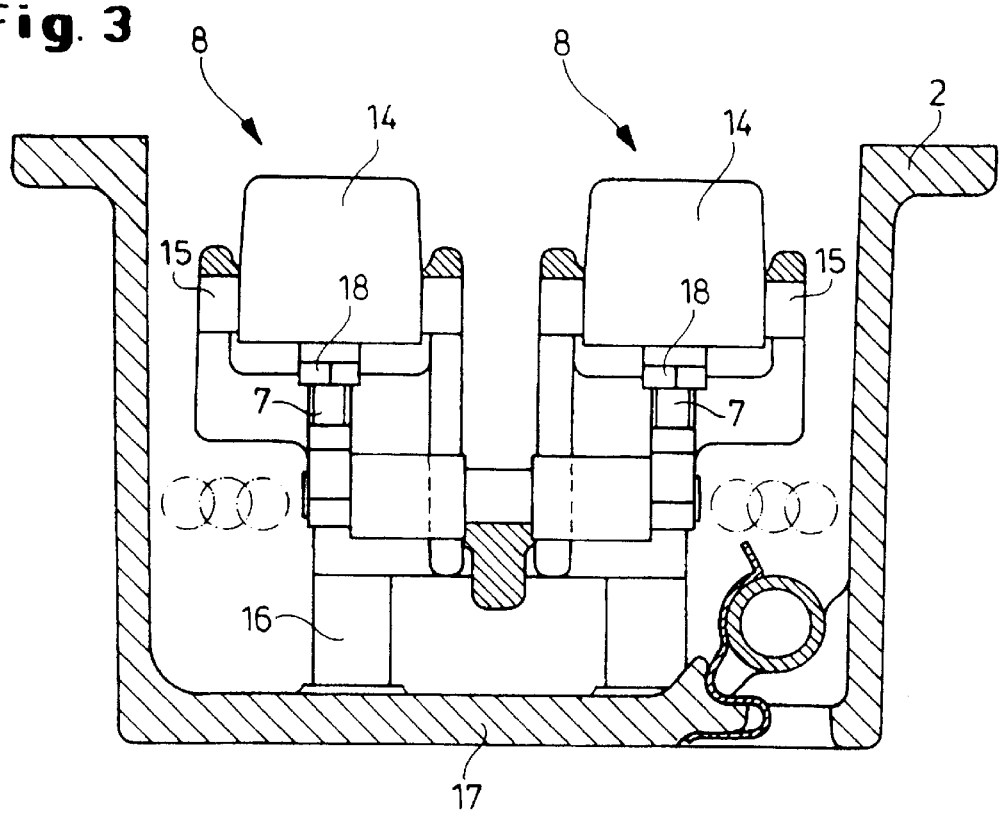
Figure 4:
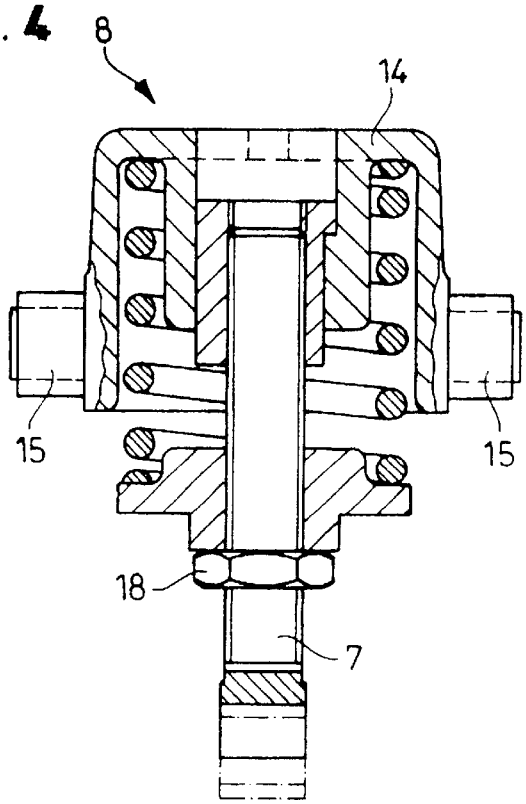

Further features and advantages of the invention will become apparent from the claims and the following description in which the exemplary embodiment of the subject matter of the invention is-discussed in detail. The drawings show:

FIG. 1 a longitudinal cross-sectional view of a point-operating device, which is arranged in a box-type cross-tie, with an associated moving device;

FIG. 2 a plan view of the box-type cross-tie according to FIG. 1;

FIG. 3 a cross-sectional view along line I—I in FIG. 1 showing two adjacent spring assemblies with the spring support sockets arranged in the box-type cross-tie;

FIG. 4 a detailed cross-sectional view showing a spring support socket with an integrated spring; and FIGS. 5*a*–5*d* longitudinal cross-sectional views of the moving device according to FIG. 1 in different operational conditions.

FIG. 1 shows a point-operating device 1 which is arranged in a box-type cross-tie 2. The box-type cross-tie 2 tightens two stock rails 3 and 4. A moving device, which is formed as a bow suspension 5, is arranged in the middle of the cross-tie 2. The bow suspension 5 is formed of a V-shaped basic carrier element 6 which has two spring assemblies 8, 9 which are arranged in tandem next to each other and are movable with pressure rods 7 (see FIG. 2), with outer spring assemblies 12, 13 together with their pressure rods 7, being arranged at the ends 10, 11 of the V-shaped carrier element 6. The spring support sockets 14 of the spring assemblies 8, 9 and 12, 13 are supported in a carrier frame 16 for rotation about the horizontal axes 15. The carrier frame 16 is secured to the bottom 17 of the box-type cross-tie 2 (see FIGS. 3 and 4). The pressure force of the spring assemblies 8, 9 and 12, 13 is continuously adjustable by an adjusting nut between 50 N and 400 N. Push rods 20, 21 are secured to the outer ends 10 and 11 of the bow suspension 5 with a screw-nut combination 19. The other ends 22, 23 of the push rods 20, 21 which are remote from the bow suspension 5, are connected by thrust members 24, 25 with tongue shackle 26, 27, respectively, with a respective switch tongue 28 which lies on the stock rail 3, and a switch tongue 29 spaced from the stock rail 4.

The push rods 20, 21 have, in the region of the thrust members 24, 25 respective toothings 30, 31 which provide for a ratchet-type adjustment of the tongue shackles 26 and 27 in the push rods 20, 21. This is effected by release and lifting of the thrust members and subsequent lowering them and securing. Thereby, it is possible to obtain a predetermined range in accordance with the position of the bow suspensions in the point-operating device 1. It also permits to adapt the thickness of the tongue heads to respective parameters such as the preload of the spring assemblies 8, 9, 12 and 13.

At the left face 32 of the cross-tie 2, there is provided a standard point detector 33 which, however, in accordance with spatial conditions, can be arranged rigthward of the face of the cross-tie 2, which is shown in FIGS. 1, 2 with dash lines. The point detector 33 is fixedly connected with upper chords 36, 37 of the cross-tie 2 by two support members 34, 35. Two point detector rods 38, 39 mechanically connect the point detector 33 with both switch tongues 28, 29 (see FIG. 2). Thereby a signalling monitoring of both switch tongues 28, 29 is reliably insured.

The switching of the switch tongues 28 and 29 by a bow suspension 5 will be now explained in detail with reference to FIGS. 5*a*–5*d*.

Figure 5A:
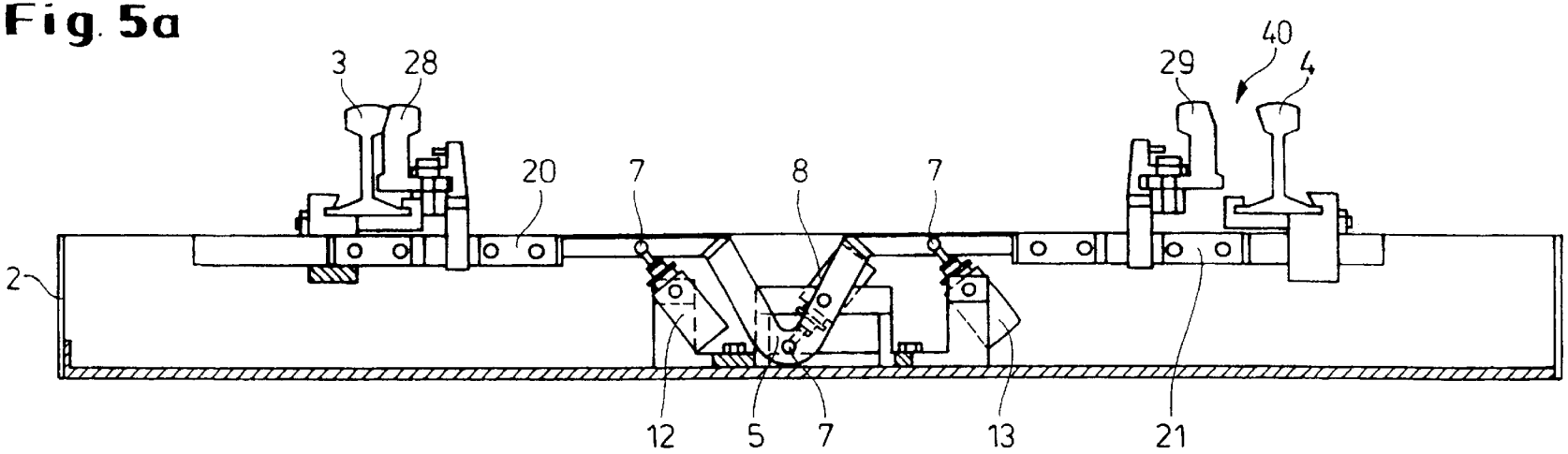

In FIG. 5*a*, the left switch tongue 28 is pressed against the stock rail 3, and the right switch tongue 29 is spaced from the stock rail 4 a distance which permits to achieve a required minimal switch opening of 58 mm. Thereby, it is insured that the backs of a wheel of a rail car would not contact the stop surface of the tongue which is very important, in particular at high speeds, as the wheel passes the opening region 40.

Figure 5B:
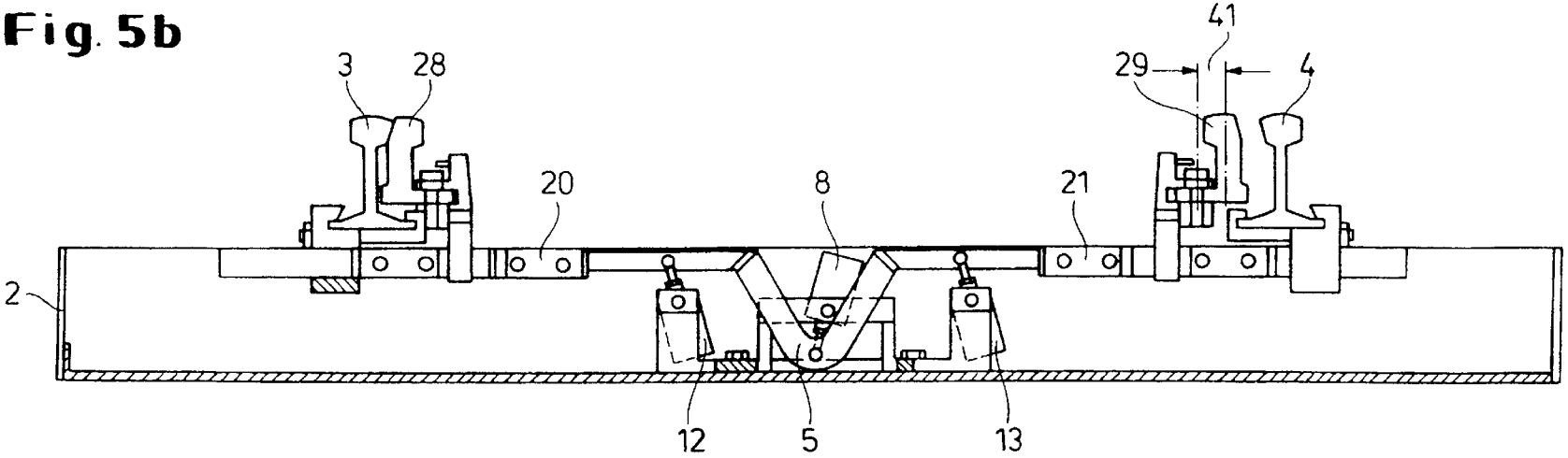
Figure 5C:
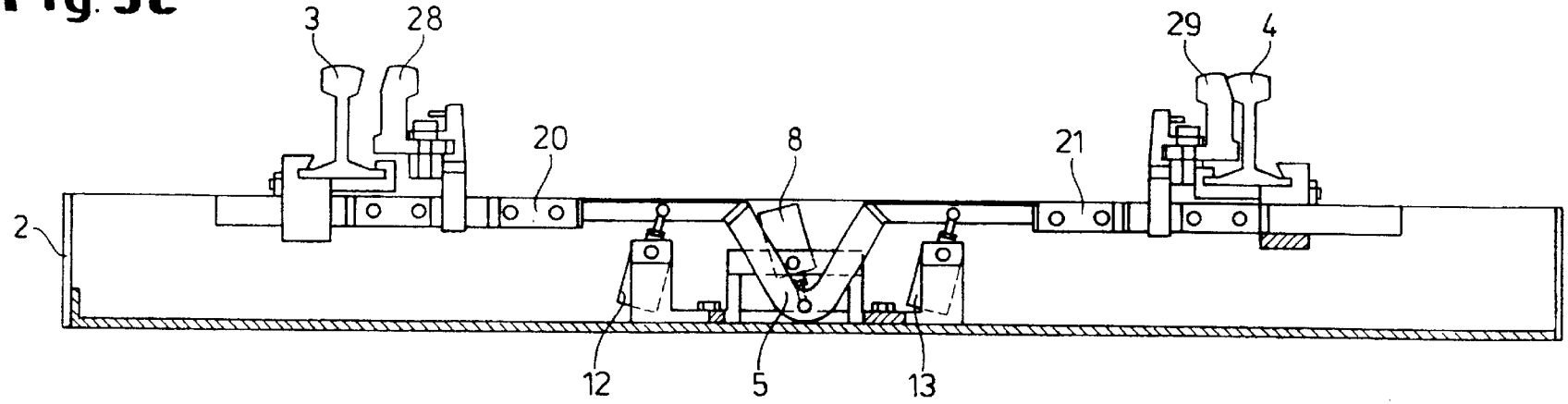

By moving the tongues 28, 29, which re connected with the bow suspension 5, by a point-operating motor which is arranged in the region of the tongue tip, not shown, the switching is effected. As shown in FIG. 5*b*, during switching of the tongues 28, 29, the tongue 29, which is spaced from the stock rail 4, moves toward the stock rail 4 and, within a time interval, the tongue 28, which lied on the stock rail 3, is moved therefrom against a spring biasing force. The release takes place only then when the previously spaced tongue 29 was displaced by the bow suspension 5 a distance in the direction of a double arrow 41 toward the stock rail 4. At this time, the tongue 28 is spaced from the stock rail 3, whereas the tongue 29 lies on the stock rail 4, as shown in FIG. 5*c*.

Figure 5D:
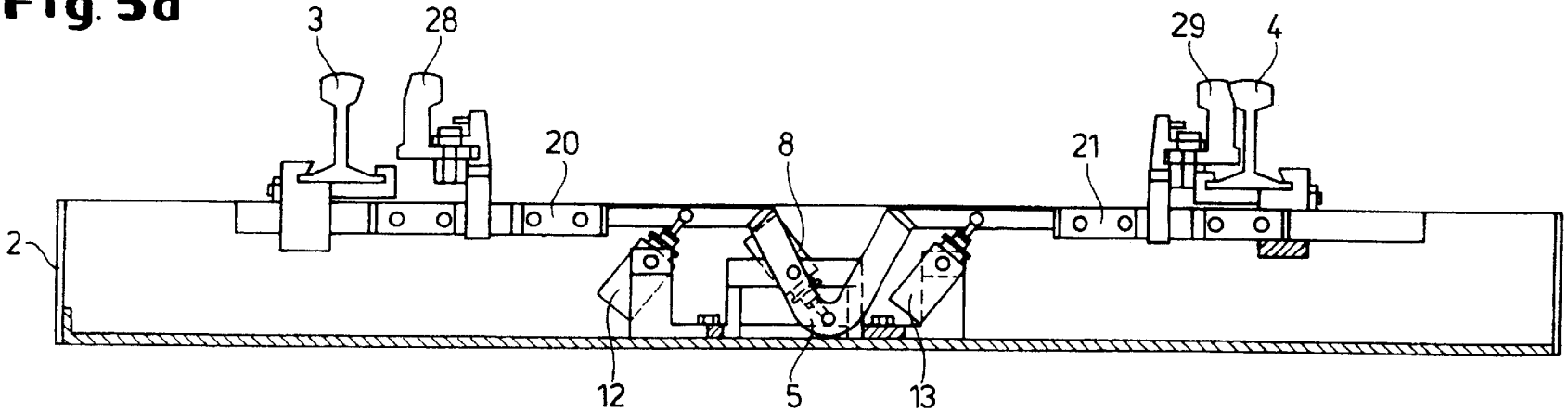

FIG. 5*d* shows that the spring assemblies are completely pivoted and thereby, the tongue 29 is pressed against the stock rail 4 with a force corresponding to a clamping lock, on one hand, and on the other hand, the tongue 28 is spaced from the left stock rail 3 by at least 58 mm and is reliably held in its position.

What is claimed is:

1. A point-operating device for pressing one switch tongue against one stock rail and for simultaneous pull-off another switch tongue from an opposite stock rail, the point-operating device comprising:

moving device to be arranged exclusively between the stock rails/switch tongues of a point, the moving device being formed as a bow suspension provided with at least four adjustable spring assemblies; and means for supporting the bow suspension for pivotal movement about horizontal pivot axes of the spring assemblies and in opposite operational positions in which the spring assemblies occupy reverse positions for pressing the one switch tongue against the one stock rail, with the other switch tongue being spaced from the opposite stock rail, and for pressing the other switch tongue against the opposite stock rail, with the one switch tongue being spaced from the one rail, respectively.

2. A point-operating device according to claim 1, wherein the at least four adjustable spring assemblies include a tandem spring assembly located in a middle of the bow suspension, a spring assembly located at a left side of the tandem spring assembly, and a spring assembly located at a right side of the tandem spring assembly.

3. A point-operating device according to claim 1, further comprising push rods for connecting outer ends of the bow suspension with the switch tongues.

4. A point-operating device according to claim 3, wherein the push rods are provided with toothing.

5. A point-operating device according to claim 1, wherein the supporting means comprises a carrier frame for supporting the spring assemblies.

* * * * *